United States Patent [19]

Torri

[11] 4,220,256

[45] Sep. 2, 1980

[54] AUTOMATIC DISPENSER FOR AUTOMATICALLY DISPENSING LIGHTED CIGARETTES

[76] Inventor: Aldo Torri, via Catalani 34, Livorno, Italy

[21] Appl. No.: 951,985

[22] Filed: Oct. 16, 1978

[51] Int. Cl.[3] ..... A24F 15/10

[52] U.S. Cl. ..... 221/147; 219/214; 219/267; 312/86

[58] Field of Search ..... 221/143–147; 219/214, 261, 262, 263, 267, 268; 206/85, 86; 312/86

[56] References Cited

U.S. PATENT DOCUMENTS

| | | | |
|---|---|---|---|
| 1,917,026 | 7/1933 | Girtanner | 221/144 X |
| 1,984,070 | 12/1934 | La Vercombe | 219/214 X |
| 2,028,787 | 1/1936 | Lane | 221/147 X |
| 3,294,285 | 12/1966 | Kovacevic | 221/147 |
| 3,943,327 | 3/1976 | Vizelyi et al. | 221/147 X |

*Primary Examiner*—F. J. Bartuska
*Attorney, Agent, or Firm*—J. Harold Nissen

[57] ABSTRACT

The automatic dispenser comprises as a unit a container for holding a plurality of unlit cigarettes which is positioned above a support adjacent to a cigarette lighter or electric heater. A rotatable dispenser which forms part of the unit is positioned between the container and the support. Electronic circuitry is provided to control the length of time the electric heater remains lit, and cam actuated switching devices are connected with the dispenser to energize the electric heater each time the dispenser moves or transports a cigarette from the container to the support for lighting the cigarette. The support is provided with an opening through which the unlit end of the cigarette may be grasped and removed after being lit.

10 Claims, 4 Drawing Figures

AUTOMATIC DISPENSER FOR AUTOMATICALLY DISPENSING LIGHTED CIGARETTES

BACKGROUND OF THE INVENTION

This invention relates to an automatic dispenser for automatically dispensing lighted cirgarettes.

More particularly, the invention is concerned with a cigarette igniting device for lighting a cigarette or the equivalent, without an individual becoming distracted or having to use his hands for a long period of time.

Vehicles such as automobiles are provided with conventional cigarette lighters which require the user to activate an electrical heater element so as to heat it to red or glowing heat. The electrical heating element is then removed from its energizer and applied to a cigarette for lighting thereof. It is well known that this procedure requires the use of at least one hand (and perhaps two hands) for a considerable period of time. And, when a driver removes one of this hands from the steering wheel, for a long period of time, full control of the vehicle becomes difficult for this particular period of time.

The present invention proposes a device which is particularly suitable for use in connection with a moving motor vehicle to provide a lighted cigarette automatically to the operator of such motor vehicle, with a minimum of effort and a minimum of time during which one hand is removed from the steering wheel and therefore, the control of the vehicle.

One of the advantages of the invention is that the apparatus for dispensing a lighted cigarette offers greater fire protection because there is no danger of damage of burning oneself as the result of droping the lighter element.

It is therefore an object of the invention to provide an automatic dispenser for automatically dispensing lighted cigarettes whereby to diminish the possiblity of accidents as the result of the driver or operator of the motor vehicle becoming distracted during the period of removal of the cigarette lighter and/or during the period of lighting the cigarette.

In accordance with the invention, the automatic cigarette dispensing device can be electrically powered from the power source of the vehicle in a conventional manner, and a container is provided for storing one or more cigarettes in an unlit condition. A cigarette cradle or support is provided to position an unlit cigarette proximate to an electric heater or lighter for lighting thereof, and a rotatable transport means is positioned between the container and the support for moving a single cigarette from the container to the support while at the same time energizing an electric circuit for heating the electric heater. Coupled with the electric heater and switch is an electronic circuit of the conventional type which controls the duration of heating of the electric heater. Coupled with the transport means is a camming mechanism for activating a switch to heat the electric heater each time the transport means is rotated to a position to place a cigarette into the support.

The automatic dispenser for automatically dispensing lighted cigarettes permits a motor vehicle operator merely by rotating a knob to obtain a cigarette which has already been lit without any other manipulations or distractions.

While the automatic dispenser has been described in connection for use with a motor vehicle, it will be obvious to those skilled in the art that it could be used as well in airplanes, in the home, on ships, and in public areas, etc.

Other objects, advantages and the nature of the invention will become readily apparent from a detailed description of the invention as described in connection with the Figures of the drawing which illustrates the preferred mode of the invention.

DESCRIPTION OF THE PREFERRED EMBODIMENT

Figure 1:
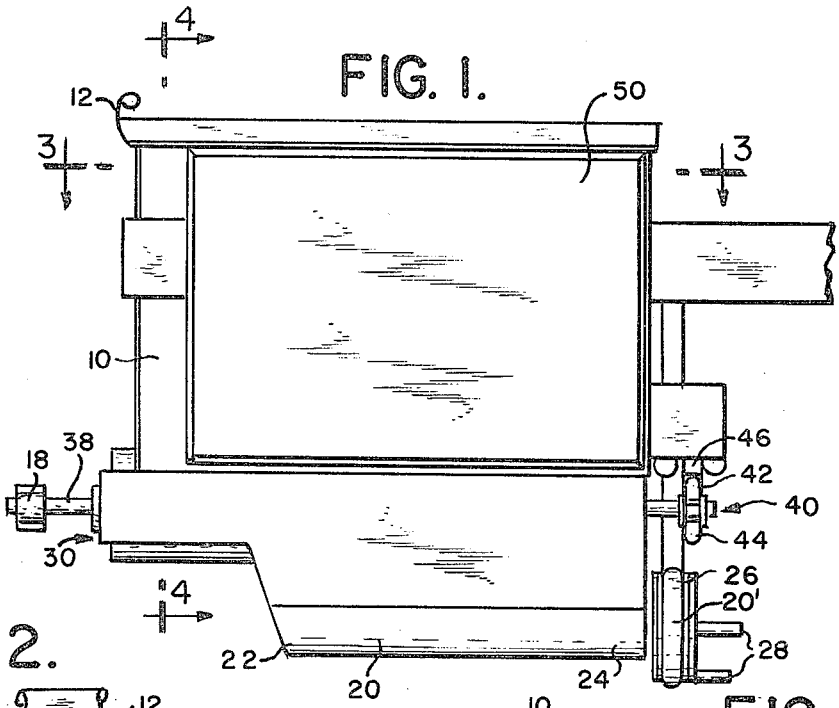
FIG. 1 is a front view of the automatic dispenser according to the invention for automatically dispensing lighted cigarettes.

Referring more particularly to the drawing which illustrates the preferred embodiment of the invention, the automatic dispenser for automatically dispensing lighted cigarettes comprises a cigarette containter 10 having a top closure 12 which when opened permits cigarettes C to be inserted into container 10, and a mouth or exit portion 14. While two columns of cigarettes are shown, it is to be understood that it is possible to have one column or more than two columns.

Positioned below the container 10 is a support or cradle 20 which includes a single concavity cigarette receiver to hold a single cigarette C. One end of the cradle 20 is provided with an opening or fore-shortened portion 22 from which an unlit end of a cigarette C may be withdrawn from the support. The other end of support 20 is provided with an opening 24 which is adjacent to an electric heater 26 of the conventional spiral type. The electric heater 26 is provided with a pair of electrical connectors 28 for connection to a suitable source of electrical energy, such as a 6, 12, or 24 volt battery, or conventional house voltage.

Positioned between container 10 and cradle 20 is a rotatable cigarette transport device 30 for transporting a single cigarette C-s from container 10 to cradle 20 for lighting of one end of the cigarette. Transport device 30 includes a rotor member 32 having two oppositely disposed concave or U-shaped cigarette receiving cavities 34 and 36 angularly displaced from each other by 180 degrees. Rotor 32 is carried on a shaft 38 which includes a rotation knob 18 at the front end and a cam device 40 having a pair of cam lobes 42 and 44 angularly displaced from each other by 180 degrees which cooperate with an activation switch 46 for connecting the electric heater 26, in a conventional manner not shown, to the source of electrical energy for energizing the electric heater to heat the heating element thereof.

Coupled in circuit with the electric heater 26 and activation switch 46 is electronic circuitry 50 of the conventional type for controlling the length of time electric heater 26 is energized. The time period is sufficient to heat the coil of heater 26 to red heat to light a cigarette held in cradle or support 20. After a predetermined time for the heating of electric heater 26, the electric circuitry 50 causes switch 46 to be moved to its off position whereby to enable it to be reactivated again upon rotation of knob 18 connected with the other end of shaft 38. Cam lobes 42 and 44 are angularly related to cigarette receiving cavities 34 and 36 to activate switch 46 to place it into its "on" condition each time one of the receiving cavities is positioned to deposit a cigarette into cradle 20.

OPERATION OF THE DEVICE

Figure 2:
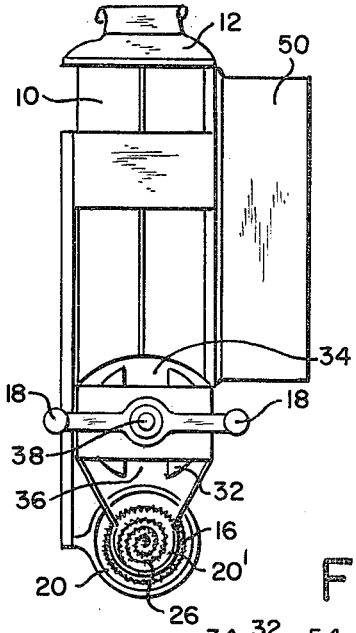
FIG. 2 is a side view of the device of FIG. 1.
Figure 4:
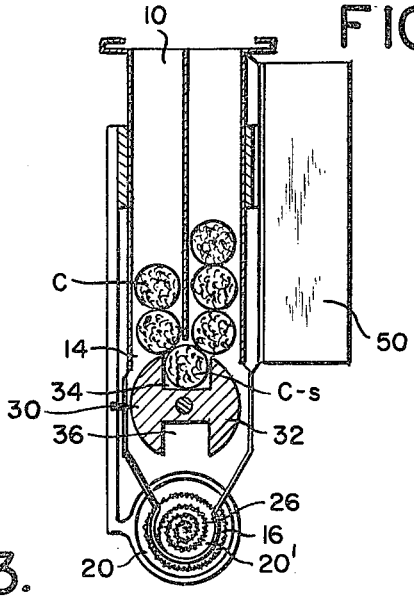
FIG. 4 is a sectional view taken along line 4—4 of FIG. 1.
Figure 3:
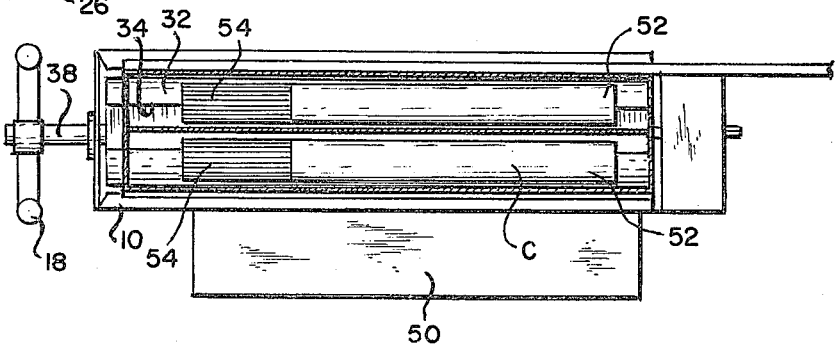
FIG. 3 is a sectional view taken along line 3—3 of FIG. 1.

As best seen in FIG. 3, cigarette C includes a front or heat end 52 which is adapted to be lit and a rear end 54 which is not intended to be lit. Upon rotation of rotor 32 by means of knob 18, cigarette receiving cavity 34 (in the position shown in FIGS. 2 and 4) is adapted to receive a cigarette C, and upon rotation of knob 18 through 180 degrees, cam lobe 42 is moved from its top position to the position of cam lobe 44, and cam lobe 44 is moved into engagement with switch 46 to place it into its "on" position to connect electric heater 26 with the source of energy; and, at the same time, rotor 32 is also rotated through 180 degrees so that the cigarette C-s which is in cavity 34 is moved to a position to drop into support or cradle 20 so that end 52 may be lit, and upon lighting of end 52 the cigarette C-s is withdrawn by grasping end 54. End 54 extends beyond the withdrawal means 22 whereby to permit removal of the lit cigarette.

The container 10 which is adapted to contain a plurality of the loose cigarettes C is superimposed above the cradle 20, and the cigarettes are superimposed one upon the other in a horizontal arrangement. The transport device 30 provides for the removal of one cigarette at a time from container 10 for placement into cradle 20. Cradle 20 is in the form of a concave support to position the front end 52 of the cigarette in proximity with the electric heater 26 which is of the spiral type. While two rows of cigarettes are shown in container 10, it is to be understood that a number of parallel rows may be used if desired. Each half turn or 180 degree turn of the knob 18 provides for the extraction of a single cigarette from the container 10. While the cam lobes 42 and 44 are shown in alignment with and in registry with cigarette receiving cavities 34 and 36, respectively, what is important is that the cam lobes 42 and 44 cooperate with the switch 46 so as to render it operative upon the rotor 32 depositing a cigarette C into cradle 20. The timing electronic circuit 50 regulates the duration of the heating of the electric heater or lighter 26 and the ignition of the front end 52 of cigarette C.

The electric heater 26 which is of the spiral type can be made for a preselected or pre-established voltage or for a number of the preselected or pre-established voltages 6, 12, 24 or normal house voltage. The electric heater 26 includes a casing 20' which is separate from and isolated from support or cradle 20 so that the heating element of the electric heater 26 is both electrically and thermally insulated from the support or cradle 20.

While there has been shown and described what is considered to be the best mode of carrying out the invention, it will be obvious to those skilled in the art that various changes and modifications may be made therein without departing from the scope of the invention as defined in the claims.

I claim:

1. An automatic dispenser for automatically dispensing lighted cigarettes, comprising in combination:

a container adapted to hold and store one or more unlit cigarettes, said container having a mouth portion from which a cigarette can be dispensed;

cigarette lighting means operatively associated with said container for receiving a cigarette therefrom and including an electric heater for lighting the head of a cigarette;

cradle means associated with said container and said cigarette lighting means adapted to receive a cigarette from said container and position said last-mentioned cigarette into juxtaposition with said cigarette lighting means, said cradle means including a cigerette withdrawal means to permit withdrawal of a cigarette from said cradle means;

transport means associated with said container and said cradle means having two operable positions, operable in one of said positions to receive a cigarette for transport thereof to said cradle means and in the other of said positions to isolate the said received cigarette from the cigarettes in said container and to position the said received cigarette in proximity with said electric heater while isolating therefrom the cigarettes remaining in said container, said transport means including a pair of spaced rotatable concave cigarette receiving and dispensing means angularly displaced 180° from each other to insure that solely one cigarette at a time is removed from said container, and a pair of cam lobes one for each said concave receiving means angularly displaced 180° from each other, said cam lobes being operatively coupled with said concave receiving means and movable therewith, respectively; and, switch means external of and associated with said transport means and said cigarette lighting means for energization thereof by coupling said heater to a source of energy when said transport means transports a cigarette from said container to said cradle means, said switch means including an activation switch operatively associated with said cam lobes for connection of said heater to the source of energy for energizing said heater for a time period sufficient to light a cigarette, said cam lobes aligned with said cigarette receiving and dispensing means to activate said activation switch upon deposit of a cigarette in said cradle means by said transport means.

2. The dispenser as claimed in claim 1, wherein said electric heater is of the electrical resistance spiral type, and said source of energy supplies said electric heater with a voltage of pre-established value.

3. The dispenser as claimed in claim 1, wherein said cradle means includes a single cigarette concavity receiver for receiving solely one cigarette, and said transport means cooperates with said cradle means so that solely one cigarette at a time is fed to said single concavity receiver, said transport means including said pair of oppositely disposed cigarette receiving cavities for receiving solely one cigarette at a time from said mouth portion of said container.

4. The dispenser as claimed in claim 1, wherein said transport means includes a rotatable knob connected with said receiving and dispensing means for external rotation thereof from a cigarette receiving position to a cigarette dispensing position, and timer means associated with said switch means to regulate the duration of the heating of said electric heater.

5. The dispenser as claimed in claim 4, wherein said timer means deactivates and activates said electric heater each time one of said cam lobes activates said switch means.

6. The dispenser as claimed in claim 1, including a common shaft, a rotation knob coupled to said common shaft for rotation thereof, said cigarette receiving and dispensing means and said cam lobes being connected with said common shaft, such that rotation of said knob rotates said cigarette receiving and dispensing means and said cam lobes as a unit, and a casing for said electric heater separate from said cradle and said transport means for isolating said electric heater from said cradle and said common shaft.

7. The dispenser as claimed in claim 1 for use in connection with a moving motor vehicle, wherein said container is superposed in horizontal arrangement above said cradle means for supporting thereabove a plurality of cigarettes in a vertical column, one said pair of concave receiving means being in alignment with said mouth portion of said container for receiving a cigarette and the other of said pair of concave receiving means being in alignment with said cradle means for dispensing vertically thereinto a previously received cigarette after one of said cam lobes has operated said activation switch and for assuring isolation between said container and said cradle, and said cigarette withdrawal means having a portion providing for the exposure of the unlit end of the cigarette in a horizontal direction relative to said vertical column of cigarettes to permit withdrawal thereof horizontally relative to the moving vehicle by grasping the unlit end of the cigarette.

8. The dispenser as claimed in claim 7, including a time electric circuit means cooperating with said switch means to control the ignition of said electric heater and the duration of the heating thereof in response to said activation of said activation switch upon rotation of said pair of concave receiving means to position a cigarette in said cradle means.

9. The dispenser as claimed in claim 1, wherein said pair of receiving and dispensing means holds solely one cigarette at a time, so that alignment of said receiving and dispensing means with said container causes said receiving and dispensing means to release a cigarette transported thereby into said cradle means, a common shaft for said receiving and dispensing means and said cam lobes for rotation thereof as a unit to release a single cigarette into said cradle and simultaneously to activate said switch means.

10. The dispenser as claimed in claim 1, wherein said transport means includes a rotatable cigarette dispensing and receiving means, a rotatable knob connected with said rotatable means for rotation thereof, and said switch means includes timer means which regulates the duration of the connection of said heater to said source of energy, said cam lobes being connected with said rotatable knob and said activation switch, rotation of said knob causes a respective one of said cam lobes to operate said activation switch for each 180° movement of said receiving means to connect said heater to said source of energy.

* * * * *